US009550639B2

(12) United States Patent
Akimatsu

(10) Patent No.: US 9,550,639 B2
(45) Date of Patent: Jan. 24, 2017

(54) SHEET SUPPORTING DEVICE AND SHEET CONVEYING DEVICE

(71) Applicant: Brother Kogyo Kabushiki Kaisha, Nagoya (JP)

(72) Inventor: Takayuki Akimatsu, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/042,749

(22) Filed: Feb. 12, 2016

(65) Prior Publication Data

US 2016/0244280 A1 Aug. 25, 2016

(30) Foreign Application Priority Data

Feb. 25, 2015 (JP) ..... 2015-035228

(51) Int. Cl.
*B65H 1/04* (2006.01)
*B65H 3/06* (2006.01)

(52) U.S. Cl.
CPC . *B65H 1/04* (2013.01); *B65H 3/06* (2013.01)

(58) Field of Classification Search
CPC ..... B65H 1/00; B65H 2405/114; B65H 2405/1142; B65H 2405/11425; B65H 2511/10; B65H 2511/12; B65H 1/04; B65H 3/06
USPC ..... 271/171
See application file for complete search history.

(56) References Cited

U.S. PATENT DOCUMENTS 7,793,930 B2 * 9/2010 Lin ..... B65H 1/04 271/171
2006/0237897 A1 * 10/2006 Terao ..... B65H 3/0661 271/145
2011/0127714 A1 * 6/2011 Kuo ..... B65H 1/00 271/171
2011/0291349 A1 12/2011 Nemura et al.
2013/0056925 A1 * 3/2013 Hsu ..... B65H 1/04 271/171

FOREIGN PATENT DOCUMENTS

JP S60-183735 U 12/1985
JP 2008-100818 A 5/2008
JP 2011-246252 A 12/2011

* cited by examiner

*Primary Examiner* — David H Bollinger
(74) *Attorney, Agent, or Firm* — Burr & Brown, PLLC

(57) ABSTRACT

A sheet supporting device, including: a sheet supporter having a support surface; a guide disposed on one side of the sheet supporter on which the support surface is provided and having a guide surface configured to come into contact with an edge, in a width direction, of a sheet on the sheet supporter; and a slider disposed on the other side of the sheet supporter, wherein the sheet supporter has an elongate opening, wherein the guide and the slider are coupled to each other through the elongate opening, such that the guide and the slider are movable together in the width direction of the sheet, and wherein the guide includes a first hook hooked on a portion of the sheet supporter and configured to be movable in the width direction of the sheet along the portion of the sheet supporter.

13 Claims, 10 Drawing Sheets

SHEET SUPPORTING DEVICE AND SHEET CONVEYING DEVICE

CROSS REFERENCE TO RELATED APPLICATION

The present application claims priority from Japanese Patent Application No. 2015-035228, which was filed on Feb. 25, 2015, the disclosure of which is herein incorporated by reference in its entirety.

BACKGROUND

Technical Field

The following disclosure relates to a sheet supporting device and a sheet conveying device.

Description of the Related Art

An automatic document feeder (ADF) of an image reading apparatus is equipped with a sheet supporting device, and sheets to be conveyed by the ADF are placed on the sheet supporting device. Such a sheet supporting device includes: a sheet supporter having a support surface for supporting sheets; and guides each configured to be movable on the support surface in a width direction of the sheets.

The sheet supporting device described above includes: a sheet supporter; guides provided on an upper side (upper surface) of the sheet supporter; and sliders provided on a lower side (lower surface) of the sheet supporter. The sheet supporter has a guide opening, and each guide and each slider are coupled by a coupling member through the guide opening.

SUMMARY

In the sheet supporting device described above, the position at which the guide and the slider are coupled, namely, the position of the coupling member, is located in the vicinity of a central portion of the guide in the conveyance direction of the sheet. In this configuration, when the guide is moved in the width direction of the sheet, either one of opposite end portions of the guide in the conveyance direction tends to be lifted up away from the sheet supporter about the central portion at which the guide and the slider are coupled. As a result, the guide is likely to wobble and creak when being operated and is hindered from moving smoothly.

In view of the situations, it is desirable to provide a sheet supporting device and a sheet conveying device in which wobbling of a guide is avoided or reduced, enabling the guide to smoothly move.

In one aspect of the disclosure, a sheet supporting device includes: a sheet supporter having a support surface for supporting a sheet to be conveyed downstream in a conveyance direction; a guide disposed on one of opposite sides of the sheet supporter on which the support surface is provided and configured to be movable along the support surface in a width direction of the sheet orthogonal to the conveyance direction, the guide having a guide surface configured to come into contact with an edge, in the width direction, of the sheet supported on the sheet supporter; and a slider disposed on the other of the opposite sides of the sheet supporter so as to be movable in the width direction of the sheet, wherein the sheet supporter is provided with an elongate opening penetrating the support surface and extending in the width direction of the sheet, wherein the guide and the slider are coupled to each other through the elongate opening, such that the guide and the slider are movable together in the width direction of the sheet, and wherein the guide includes a first hook hooked on a portion of the sheet supporter at a position spaced downstream of the elongate opening in the conveyance direction, the first hook being configured to be movable in the width direction of the sheet along the portion of the sheet supporter.

In another aspect of the disclosure, a sheet conveying device includes: a sheet conveyor configured to convey a sheet downstream in a conveyance direction along a conveyance path; a sheet supporter having a support surface for supporting a sheet to be conveyed downstream in a conveyance direction by the sheet conveyor; a guide disposed on one of opposite sides of the sheet supporter on which the support surface is provided and configured to be movable along the support surface in a width direction of the sheet orthogonal to the conveyance direction, the guide having a guide surface configured to come into contact with an edge, in the width direction, of the sheet supported on the sheet supporter; and a slider disposed on the other of the opposite sides of the sheet supporter so as to be movable in the width direction of the sheet, wherein the sheet supporter is provided with an elongate opening penetrating the support surface and extending in the width direction of the sheet, wherein the guide and the slider are coupled to each other through the elongate opening, such that the guide and the slider are movable together in the width direction of the sheet, and wherein the guide includes a first hook hooked on a portion of the sheet supporter at a position spaced downstream of the elongate opening in the conveyance direction, the first hook being configured to be movable in the width direction of the sheet along the portion of the sheet supporter.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

There will be hereinafter described a sheet supporting device and a sheet conveying device according to one embodiment.

Structure of MFP

Figure 1:
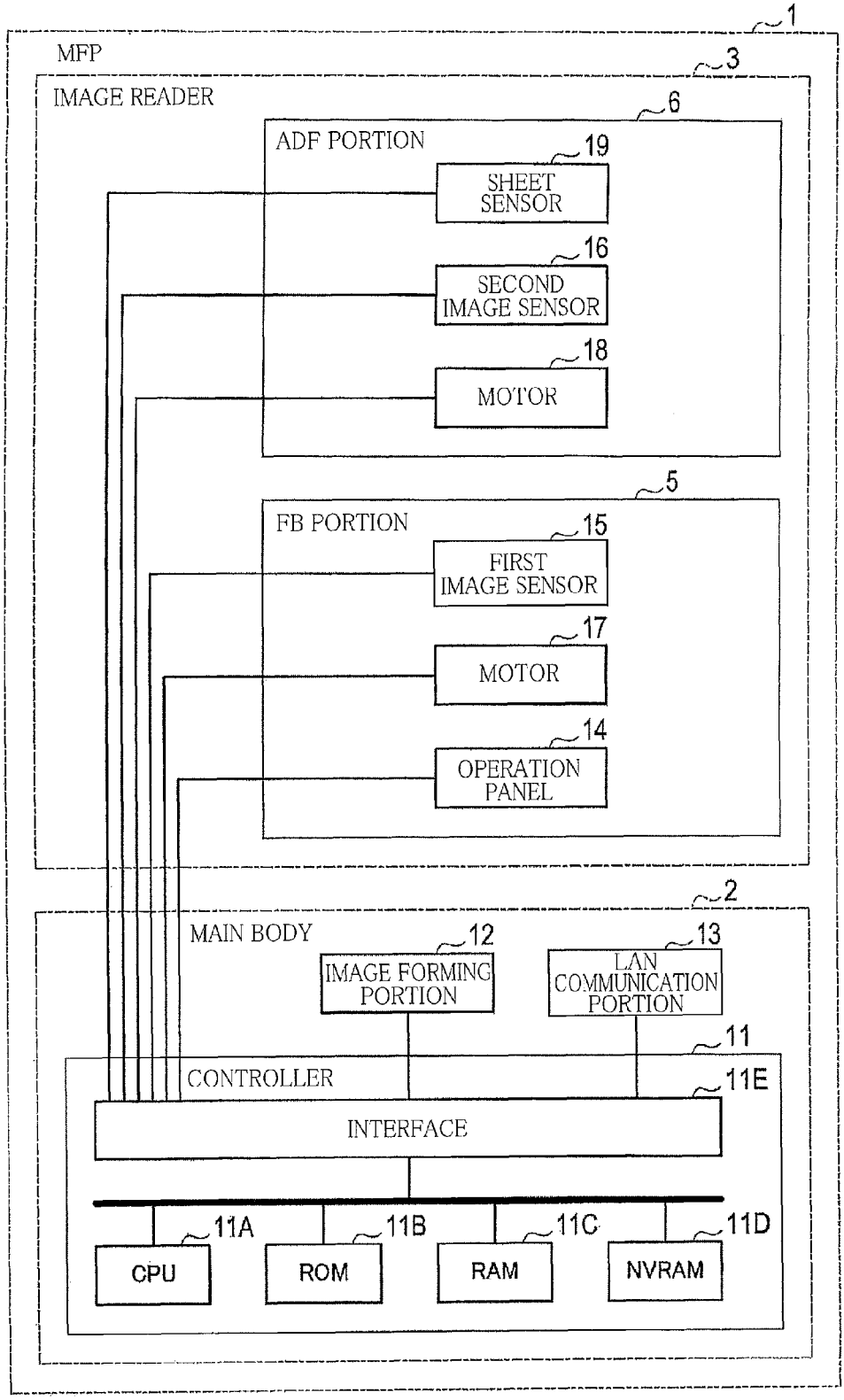
FIG. 1 is a block diagram showing a configuration of a multifunction peripheral according to one embodiment.

A multifunction peripheral (MFP) 1 shown in FIG. 1 has a structure corresponding to one example of the sheet supporting device and the sheet conveying device described above. As shown in FIG. 1, the MFP 1 includes a main body 2 and an image reader 3. The image reader 3 includes a flatbed (FB) portion 5 and an automatic document feeder (ADF) portion 6 (as one example of "sheet conveying device"). The image reader 3 will be later described in detail.

As shown in FIG. 1, a controller 11 is provided in the main body 2. The controller 11 includes a CPU 11A, a ROM 11B, a RAM 11C, an NVRAIVI 11D, and an interface 11E which are known in the art. The CPU 11A executes predetermined processes according to control programs stored in the ROM 11B and the RAM 11C, for controlling components and devices of the MFP 1 are controlled.

The components and devices controlled by the controller 11 include an image forming portion 12, a LAN communication portion 13, an operation panel 14, a first image sensor 15, a second image sensor 16, a motor 17, a motor 18, and a sheet sensor 19. The image forming portion 12 and the LAN communication portion 13 are provided in the main body 2. The first image sensor 15, the operation panel 14, and the motor 17 are provided in the FB portion 5. The second image sensor 16, the motor 18, and the sheet sensor 19 are provided in the ADF portion 6.

The image forming portion 12 is capable of forming an image on a recording medium by an ink-jet method. Specifically, the image forming portion 12 includes a conveyor for conveying the recording medium, a recording head for ejecting ink, and a drive mechanism for reciprocating the recording head. These are known in the art and a description and illustration thereof are dispensed with. The image forming portion 12 may be configured to form an image on a recording medium by an electrophotographic method.

The LAN communication portion 13 includes a communication interface device for wireless LAN and a communication interface device for wired LAN. The operation panel 14 includes: input devices, such as a touch panel, buttons, and switches, operated by a user for inputting instructions to the MFP 1; and output devices, such as a liquid crystal display and lamps, for notifying the user of an operating state of the MFP 1.

Both of the first image sensor 15 and the second image sensor 16 are a contact image sensor (CIS) in the present embodiment. The motor 17 is a power source for operating the first image sensor 15. The motor 18 is a power source for operating the ADF portion 6 to convey a sheet. The sheet sensor 19 is configured to detect passage, through a predetermined detecting position, of a leading edge or a trailing edge of the sheet conveyed by the ADF portion 6 in the conveyance direction.

In the present embodiment, the sheet sensor 19 is a contact sensor configured to be switched between on and off depending upon whether or not the sheet being conveyed is in contact with the sensor. It is noted that a sensor of another type may be used in place of the contact sensor. For instance, there may be used a non-contact sensor capable of detecting passage of that the leading edge or the trailing edge of the sheet in the conveyance direction through the predetermined detecting position. Such a non-contact sensor includes: an optical sensor capable of detecting whether or not the sheet being conveyed is intercepting an optical path; and an optical sensor capable of detecting whether or not light is reflected by the sheet being conveyed.

Details of Image Reader

Figure 2:
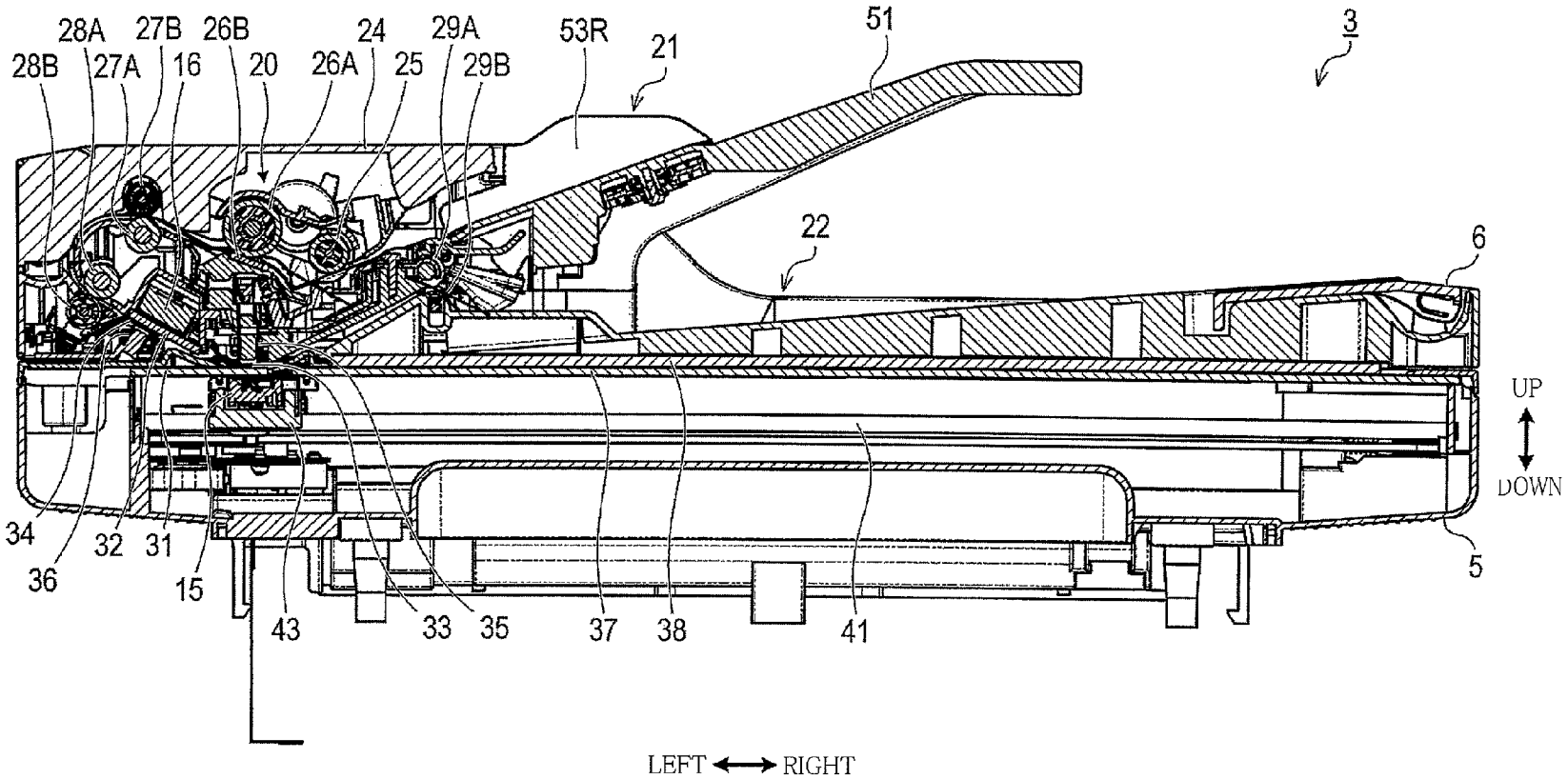
FIG. 2 is a vertical cross-sectional view of an image reader.

As shown in FIG. 2, the ADF portion 6 of the image reader 3 includes a sheet conveyor 20 configured to convey a sheet along a conveyance path. A sheet supply portion 21 (as one example of "sheet supporting device") is provided upstream of the sheet conveyor 20 in the conveyance direction. The sheet supply portion 21 is configured to support sheets to be supplied to the sheet conveyor 20. A sheet discharge portion 22 is provided downstream of the sheet conveyor 20 in the conveyance direction. The sheet discharge portion 22 is configured to support the sheets discharged from the sheet conveyor 20. An upper cover 24 is provided over the sheet conveyor 20 so as to cover the sheet conveyor 20.

The sheet conveyor 20 includes a supply roller 25, a separating roller 26A, a separating piece 26B, a first conveying roller 27A, a first pinch roller 27B, a second conveying roller 28A, a second pinch roller 28B, a discharge roller 29A, and a discharge pinch roller 29B.

The sheets supported on the sheet supply portion 21 are supplied by the supply roller 25 toward a downstream side in the conveyance direction and are separated one by one by the separating roller 26A and the separating piece 26B. The sheet is further conveyed toward the downstream side by the first conveying roller 27A and the second conveying roller 28A and is finally discharged onto the sheet discharge portion 22 by the discharge roller 29A.

A first ADF platen 31 is provided along and under the lowest portion of the conveyance path. A first pressing member 33 is provided so as to be opposed to the first ADF platen 31 with the conveyance path interposed therebetween. The first pressing member 33 is opposed to the first ADF platen from above. A second ADF platen 32 is provided along and over a portion of the conveyance path that extends obliquely downward from the second conveying roller 28A toward the first ADF platen 31. A second pressing member 34 is provided so as to be opposed to the second ADF platen 32 with the conveyance path interposed therebetween. The second pressing member 34 is opposed to the second ADF platen 32 from obliquely below.

The first ADF platen 31 is provided in the FB portion 5. The second ADF platen 32, the first pressing member 33, and the second pressing member 34 are provided in the ADF portion 6. In the present embodiment, each of the first ADF platen 31 and the second ADF platen 32 is a glass plate, and each of the first pressing member 33 and the second pressing member 34 is a metal member (metal plate).

The first pressing member 33 is urged toward the first ADF platen 31 by a spring 35. The sheet passing while contacting an upper surface of the first ADF platen 31 is pressed onto the first ADF platen 31. In this respect, the first pressing member 33 is provided with projections (not shown) formed on its surface facing the first ADF platen 31 at opposite end portions of the first pressing member 33 in the front-rear direction. The first pressing member 33 is held in contact with the first ADF platen 31 at the projections, so that a small clearance corresponding to the height of the projections is formed between the first ADF platen 31 and the surface of the first pressing member 33 facing the first ADF platen 31.

When the sheet is conveyed between the first ADF platen 31 and the first pressing member 33, the first pressing member 33 presses the sheet onto the first ADF platen 31 with the small clearance maintained. The spring 35 urges the first pressing member 33 toward the first ADF platen 31 with an urging force in such a magnitude that does not hinder conveyance of the sheet. This configuration prevents the sheet from floating up from the first ADF platen 31.

The second pressing member 34 is urged toward the second ADF platen 32 by a spring 36. The sheet passing while contacting a lower surface of the second ADF platen 32 is pressed onto the second ADF platen 32. In this respect, the second pressing member 34 is also provided with projections (not shown) on its surface facing the second ADF platen 32 at opposite end portions of the second pressing member 34 in the front-rear direction. The second pressing member 34 is held in contact with the second ADF platen 32 at the projections, so that a small clearance corresponding to the height of the projections is formed between the second ADF platen 32 and the surface of the second pressing member 34 facing the second ADF platen 32.

When the sheet is conveyed between the second ADF platen 32 and the second pressing member 34, the second pressing member 34 presses the sheet onto the second ADF platen 32 with the small clearance maintained. The spring 36 urges the second pressing member 34 toward the second ADF platen 32 with an urging force in such a magnitude that does not hinder conveyance of the sheet. This configuration prevents the sheet from floating away from the second ADF platen 32.

The FB portion 5 includes an FB platen 37, and the ADF portion 6 includes a pressing member 38. Like the first ADF platen 31 and the second ADF platen 32, the FB platen 37 is a glass plate in the present embodiment. The pressing member 38 is constituted by a layered body including a plastic foam layer and a hard resin film layer. When the ADF portion 6 is closed, the pressing member 38 is brought into close contact with the FB platen 37 while involving slight elastic deformation. In an instance where an object to be read is placed on the FB platen 37, the pressing member 38 presses the object onto the FB platen 37 when the ADF portion 6 is closed.

The second ADF platen 32 and the second pressing member 34 are disposed so as to be inclined relative to an upper surface of the FB platen 37, i.e., a support surface of the FB platen 37 on which the object to be read is supported. Thus, a portion of the conveyance path defined between the second ADF platen 32 and the second pressing member 34 is inclined from the upper left to the lower right. This configuration reduces a horizontal length of an area occupied by the portion of the conveyance path defined between the second ADF platen 32 and the second pressing member 34, as compared with a configuration in which the portion of the conveyance path extends horizontally. It is thus possible to reduce a horizontal size of a structure around the area occupied by the portion of the conveyance path defined between the second ADF platen 32 and the second pressing member 34, resulting in an accordingly reduced footprint of the MFP 1.

The FB portion 5 includes a guide rail 41 and a carriage 43. The guide rail 41 extends in the right-left direction over an area under the first ADF platen 31 and the FB platen 37, so as to be in parallel with lower surfaces of the first ADF platen 31 and the FB platen 37.

The carriage 43 is mounted on the guide rail 41 such that the carriage 43 is supported so as to be reciprocable along the guide rail 41 in the right-left direction. The carriage 43 is coupled to toothed belt (not shown). When the toothed belt is driven and rotated by power transmitted form the motor 17, the carriage 43 is reciprocated in the right-left direction following the toothed belt.

The first image sensor 15 is mounted on the carriage 43 and is reciprocated in the right-left direction with the carriage 43. The second image sensor 16 is not moved from a position at which the second image sensor 16 is opposed to the conveyance path with the second ADF platen 32 interposed therebetween. A plurality of reading elements of each of the first image sensor 15 and the second image sensor 16 are arranged in the front-rear direction.

In reading an image of the object (e.g., a sheet or a book) which is placed on the upper surface of the FB platen 37, the first image sensor 15 reads the image while moving with the carriage 43 in a direction (sub scanning direction) orthogonal to a direction (main scanning direction) in which the reading elements of the first image sensor 15 are arranged. In reading an image of the sheet conveyed by the sheet conveyor 20, the first image sensor 15 stays stationary under the first pressing member 33 and the first ADF platen 31 so as to read the image of the sheet passing while contacting the upper surface of the first ADF platen 31. The second image sensor 16 reads, above the second pressing member 34 and the second ADF platen 32, the image of the sheet passing while contacting the lower surface of the second ADF platen 32.

Details of Sheet Supply Portion

Figure 3:
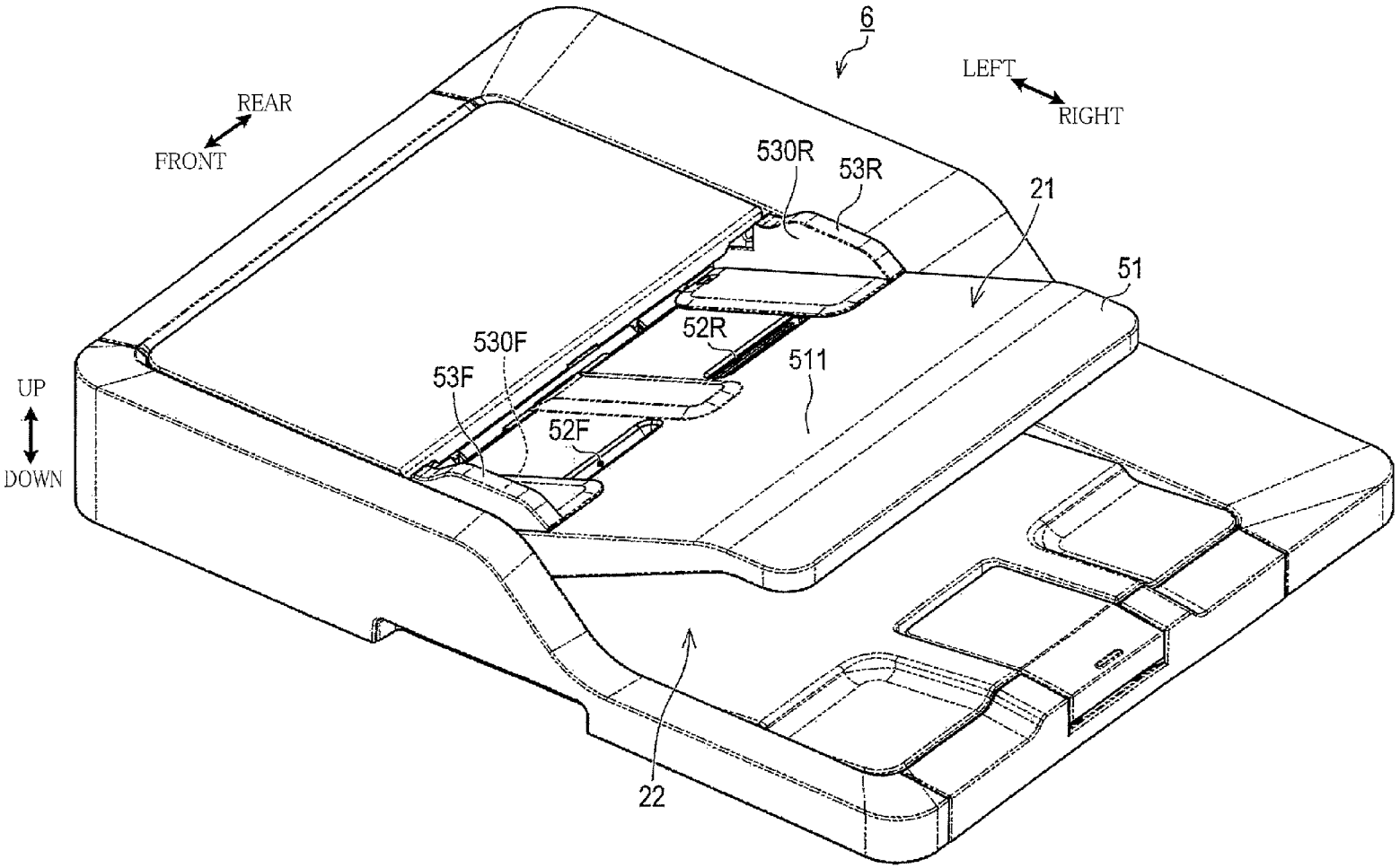
FIG. 3 is a perspective view showing an external appearance of an ADF portion.

As shown in FIG. 3, the sheet supply portion 21 includes a sheet supporter 51. The sheet supporter 51 has a support surface 511 for supporting a sheet to be conveyed downstream in the conveyance direction by the sheet conveyor 20 (FIG. 2). The sheet supporter 51 is provided with elongate openings 52F, 52R penetrating the support surface 511 and extending in a width direction of the sheet, i.e., the front-rear direction.

Figure 4:
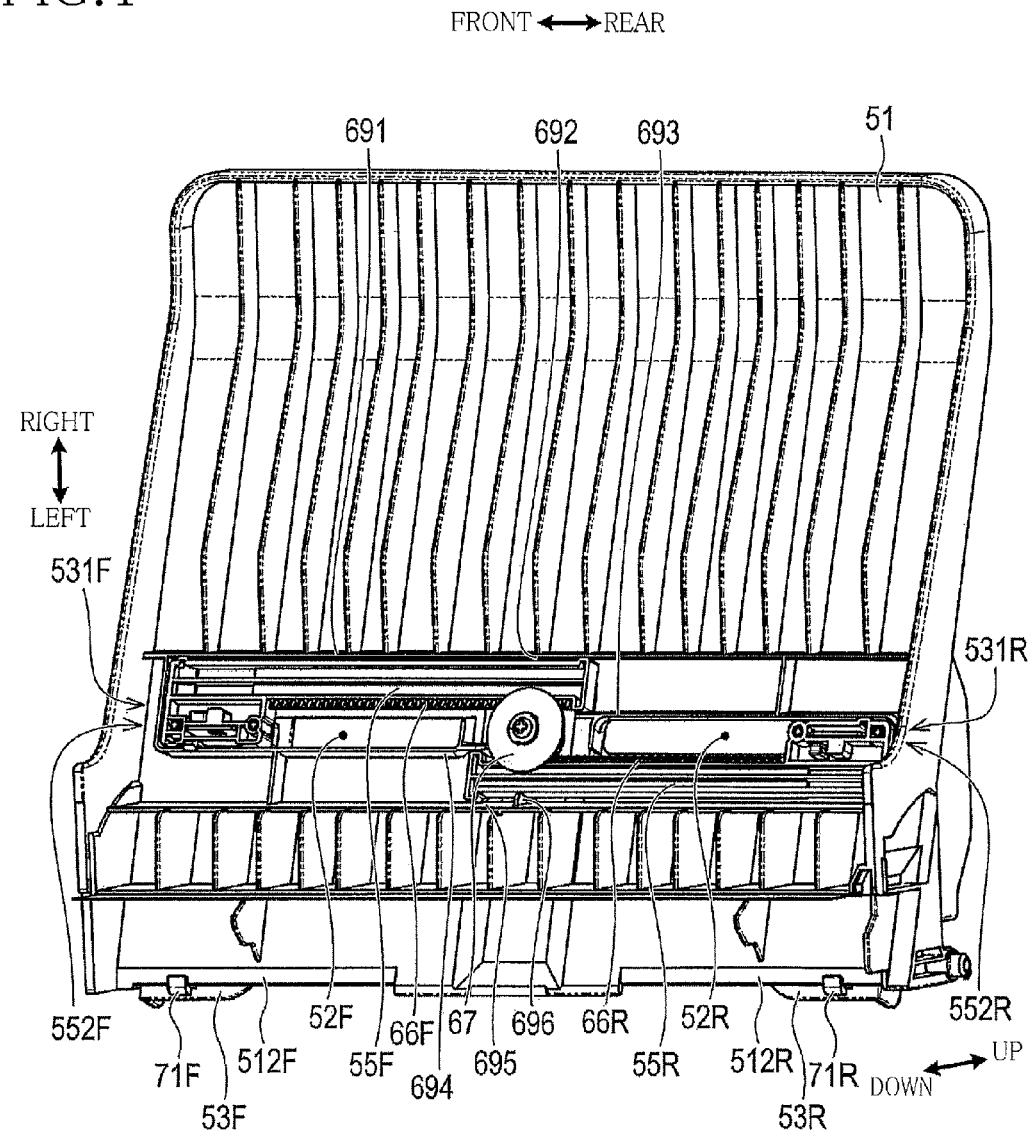
FIG. 4 is a perspective view showing a configuration of a sheet supply portion on its lower side.

In the sheet supply portion 21, guides 53F, 53R are disposed on one of opposite sides of the sheet supporter 51 (i.e., an upper side) on which the support surface 511 is provided. The guide 53F is disposed at a front portion of the sheet supporter 51 and has a guide surface 530F extending in a direction orthogonal to the support surface 511. The guide 53R is disposed at a rear portion of the sheet supporter 51 and has a guide surface 530R extending in the direction orthogonal to the support surface 511. The guide surface 530F and the guide surface 530R are opposed to each other. As shown in FIG. 4, sliders 55F, 55R are disposed on the other of the opposite sides of the sheet supporter 51 (i.e., a lower side). The slider 55F extends in a direction from the front portion of the sheet supporter 51 toward the rear portion of the same 51. The slider 55R extends in a direction from the rear portion of the sheet supporter 51 toward the front portion of the same 51. The guide 53F and the slider 55F are coupled to each other through the elongate opening 52F, such that the guide 53F and the slider 55F are movable together in the width direction of the sheet (hereinafter referred to as "sheet width direction"). The guide 53R and the slider 55R are coupled to each other through the elongate opening 52R, such that the guide 53R and the slider 55R are movable together in the sheet width direction.

Figure 5:
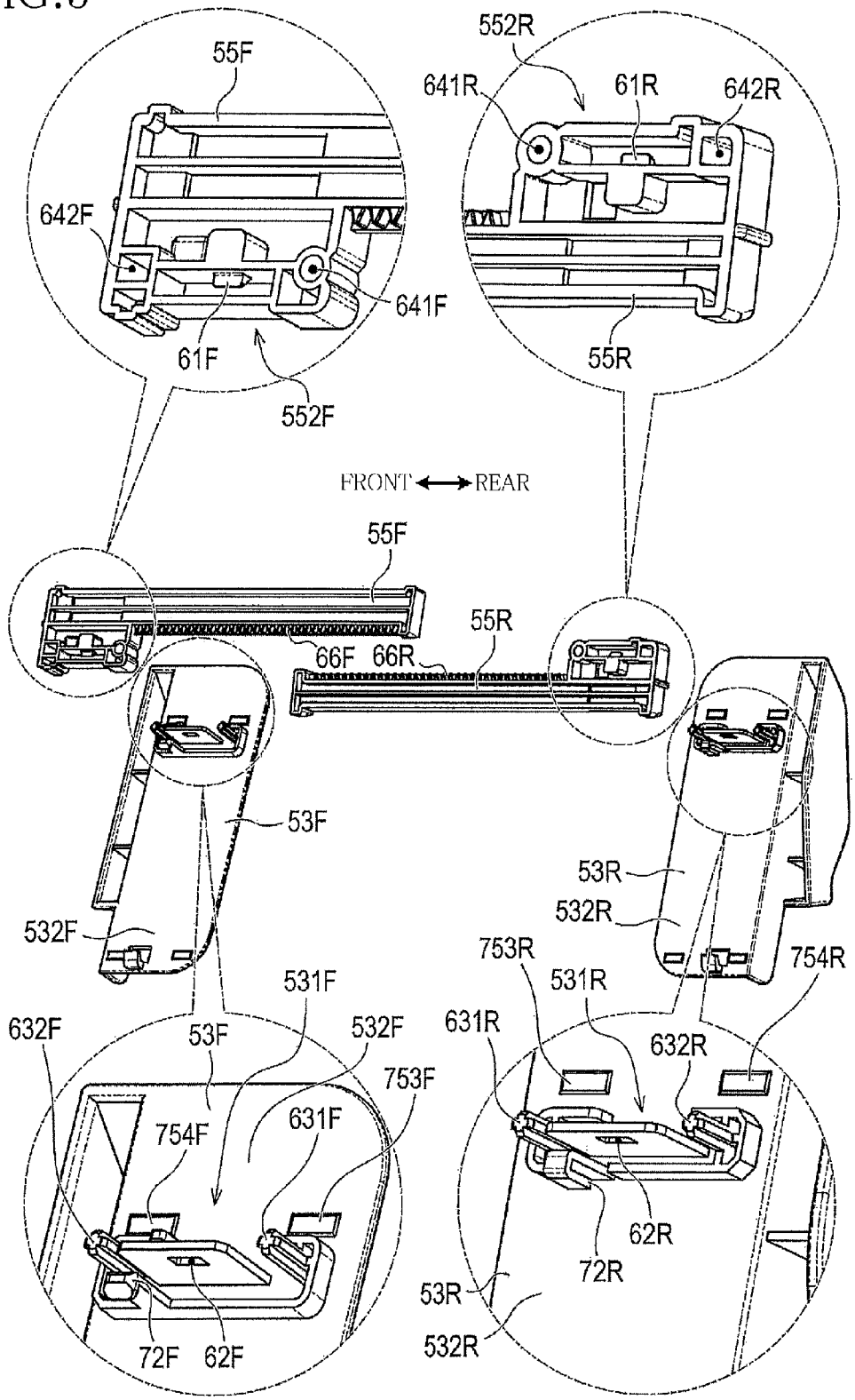
FIG. 5 is a perspective view of a coupling structure of each guide and each slider in a disassembled state.

Specifically, the guide 53F includes a first coupling portion 531F, and the guide 53R includes a first coupling portion 531R, as shown in FIG. 5. The slider 55F includes a second coupling portion 552F, and the slider 55R includes a second coupling portion 552R, as shown in FIG. 5. As later described in detail, the first coupling portion 531F and the second coupling portion 552F are coupled to each other, and the first coupling portion 531R and the second coupling portion 552R are coupled to each other.

An engaging portion 61F in the form of a projected piece is formed at one of the first coupling portion 531F and the second coupling portion 552F which are coupled to each other (i.e., the second coupling portion 552F in the present embodiment). An engaged portion 62F is formed at the other of the first coupling portion 531F and the second coupling portion 552F (i.e., the first coupling portion 531F in the present embodiment). The engaged portion 62F is an aperture which is formed in a plate-shaped protruded portion of the first coupling portion 531F and into which the engaging portion 61F is caught.

An engaging portion 61R in the form of a projected piece is formed at one of the first coupling portion 531R and the second coupling portion 552R which are coupled to each other (i.e., the second coupling portion 552R in the present embodiment). An engaged portion 62R is formed at the other of the first coupling portion 531R and the second coupling portion 552R (i.e., the first coupling portion 531R in the present embodiment). The engaged portion 62R is an aperture which is formed in a plate-shaped protruded portion of the first coupling portion 531R and into which the engaging portion 61R is caught.

Column-shaped fitting portions 631F, 632F are formed at one of: the coupling portion having the engaging portion 61F (i.e., the second coupling portion 552F in the present embodiment); and the coupling portion having the engaged portion 62F (i.e., the first coupling portion 531F in the present embodiment). In the present embodiment, the fitting portions 631F, 632F are formed at the first coupling portion 531F. Fitted portions 641F, 642F having holes into which the respective fitting portions 631F, 632F are fitted are formed at the other of the coupling portions. In the present embodiment, the fitted portions 641F, 642F are formed at the second coupling portion 552F. Column-shaped fitting portions 631R, 632R are formed at one of: the coupling portion having the engaging portion 61R (i.e., the second coupling portion 552R in the present embodiment); and the coupling portion having the engaged portion 62R (i.e., the first coupling portion 531R in the present embodiment). In the present embodiment, the fitting portions 631R, 632R are formed at the first coupling portion 531R. Fitted portions 641R, 642R having holes into which the respective fitting portions 631R, 632R are fitted are formed at the other of the coupling portions. In the present embodiment, the fitted portions 641R, 642R are formed at the second coupling portion 552R. It is noted that the fitting portions may be formed at the coupling portion having the engaging portion and the fitted portions may be formed at the coupling portion having the engaged portion.

Specifically, the fitting portions 631F, 632F are respectively formed at one and the other of two positions of the first coupling portion 531F between which the plate-shaped protruded portion having the engaged portion 62F in the form of the aperture is interposed in the front-rear direction. The fitting portion 631F is located on the rear side and the fitting portion 632F is located on the front side. The fitting portions 631R, 632R are respectively formed at one and the other of two positions of the first coupling portion 531R between which the plate-shaped protruded portion having the engaged portion 62R in the form of the aperture is interposed in the front-rear direction. The fitting portion 631R is located on the front side and the fitting portion 632R is located on the rear side. The fitted portions 641F, 642F are respectively formed at one and the other of two positions of the second coupling portion 552F between which the engaging portion 61F is interposed in the front-rear direction. The fitted portion 641F is located on the rear side and the fitted portion 642F is located on the front side. The fitted portions 641R, 642R are respectively formed at one and the other of two positions of the second coupling portion 552R between which the engaging portion 61R is interposed in the front-rear direction. The fitted portion 641R is located on the front side and the fitted portion 642R is located on the rear side.

Figure 6:
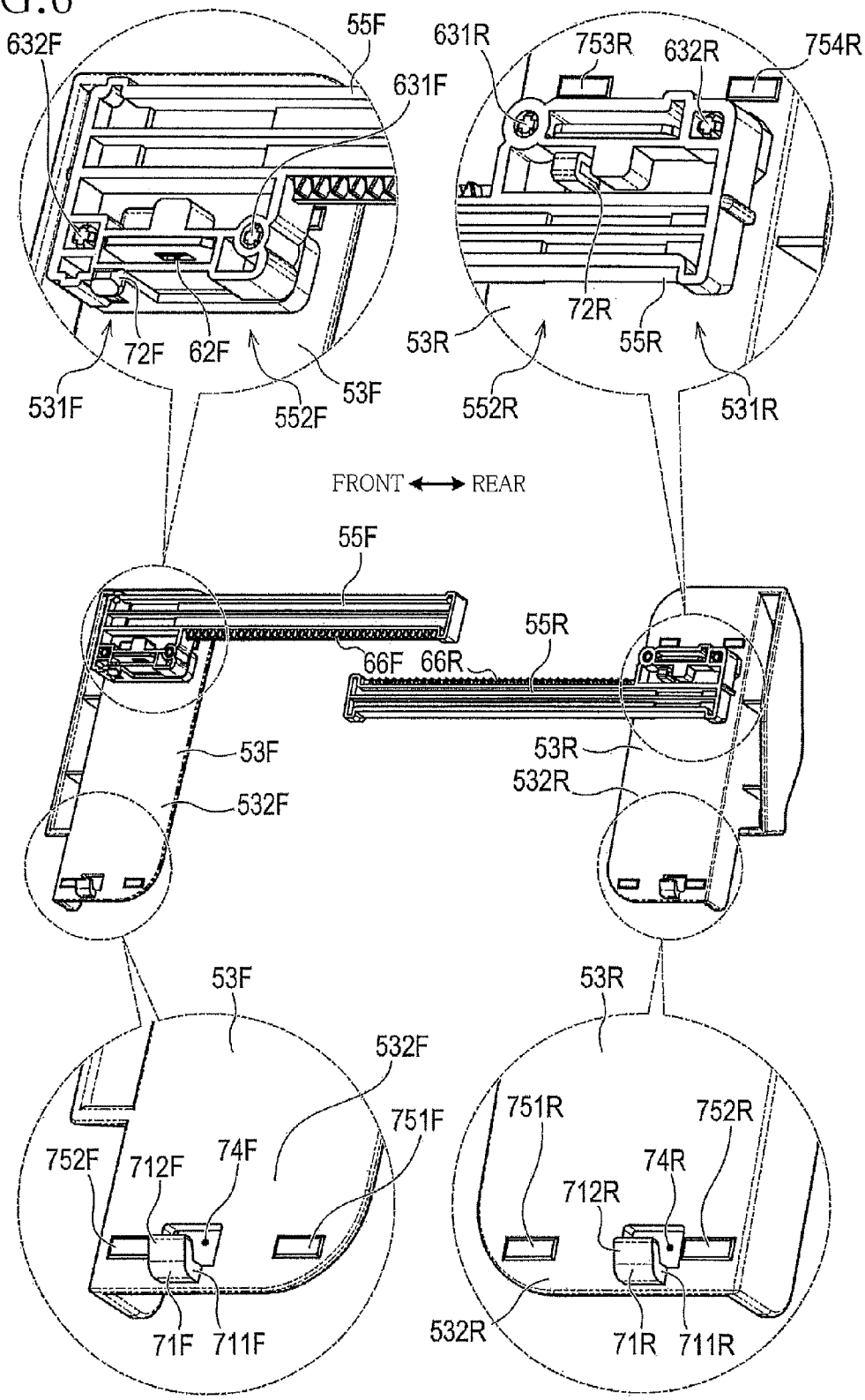
FIG. 6 is a perspective view of the coupling structure of each guide and each slider in an assembled state.

In coupling the guide 53F and the slider 55F to each other, the fitting portion 631F is fitted into the fitted portion 641F, and the fitting portion 632F is fitted into the fitted portion 642F. In this instance, the engaging portion 61F and the engaged portion 62F are brought into engagement with each other such that at least one of the engaging portion 61F and the engaged portion 62F is elastically deformed in a direction different from a direction in which the fitting portions 631F, 632F are pulled out from the respective fitted portions 641F, 642F. As a result, the guide 53F and the slider 55F are coupled to each other as shown in FIG. 6. As described above, the guide 53F and the slider 55F are coupled to each other through the elongate opening 52F of the sheet supporter 51, but the sheet supporter 51 is not illustrated in FIG. 6.

The guide 53R and the slider 55R are similarly coupled to each other. That is, the fitting portion 631R is fitted into the fitted portion 641R, and the fitting portion 632R is fitted into the fitted portion 642R. In this instance, the engaging portion 61R and the engaged portion 62R are brought into engagement with each other such that at least one of the engaging portion 61R and the engaged portion 62R is elastically deformed in a direction different from a direction in which the fitting portions 631R, 632R are pulled out from the respective fitted portions 641R, 642R. As a result, the guide 53R and the slider 55R are coupled to each other as shown in FIG. 6. As described above, though the sheet supporter 51 is not illustrated in FIG. 6, the guide 53R and the slider 55R are coupled to each other through the elongate opening 52R of the sheet supporter 51.

Figure 7A:
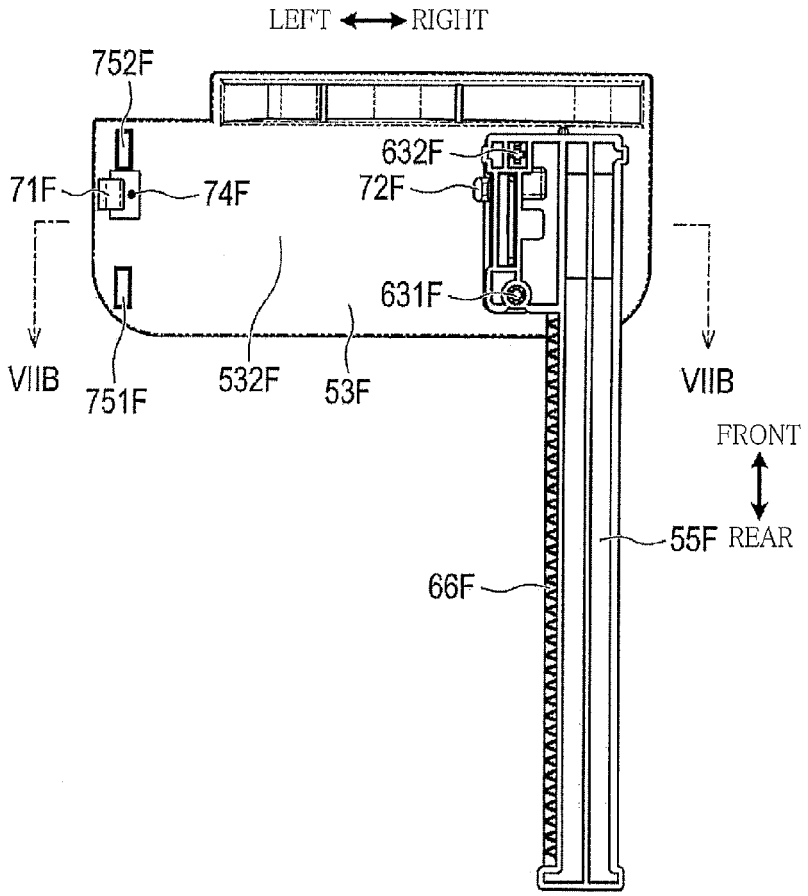
FIG. 7A is a view for explaining a cut portion corresponding to a cross-section shown in FIG. 7B
Figure 7B:
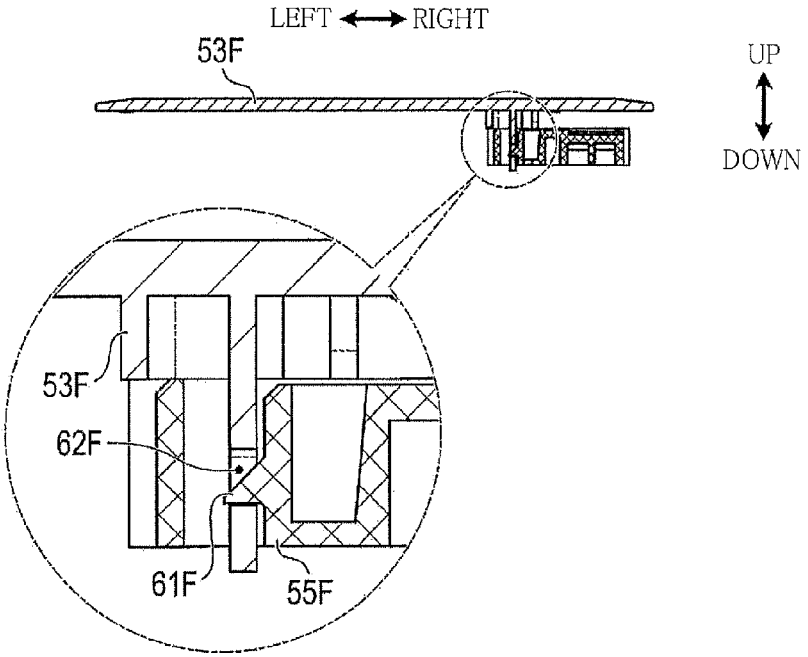
FIG. 7B is a cross-sectional view of the cut portion taken along line VIIB-VIIB in FIG. 7A.

The fitting portions 631F, 632F, 631R, 632R and the fitted portions 641F, 642F, 641R, 642R have rigidity that does not allow easy deformation thereof due to application of external force thereto within an expected range in a state in which the guides 53F, 53R and the sliders 55F, 55R are coupled. Consequently, the fitting portions 631F, 632F, 631R, 632R and the fitted portions 641F, 642F, 641R, 642R prohibit the guides 53F, 53R and the sliders 55F, 55R from moving relative to each other in directions other than the direction in which the fitting portions 631F, 632F, 631R, 632R are pulled out from the respective fitted portions 641F, 642F, 641R, 642R. As shown in FIGS. 7A and 7B showing the guide 53F and the slider 55F coupled to each other, for instance, the engaging portions 61F, 61R and the engaged portions 62F, 62R are held in engagement with each other, thereby prohibiting the guides 53F, 53R and the sliders 55F, 55R from moving relative to each other in the direction in which the fitting portions 631F, 632F, 631R, 632R are pulled out from the fitted portions 641F, 642F, 641R, 642R.

In the present embodiment, in particular, the direction in which the fitting portions 631F, 632F, 631R, 632R are pulled out from the fitted portions 641F, 642F, 641R, 642R (hereinafter referred to as "pull-out direction" where appropriate) is substantially orthogonal to the support surface 511. Further, the direction of elastic deformation of at least one of the engaging portion 61F and the engaged portion 62F when the engaging portion 61F and the engaged portion 62F are brought into engagement with each other and the direction of elastic deformation of at least one of the engaging portion 61R and the engaged portion 62R when the engaging portion 61R and the engaged portion 62R are brought into the engagement with each other are substantially parallel to the support surface 511. Thus, the above-indicated pull-out direction and the above-indicated direction of elastic deformation are substantially orthogonal to each other. In this configuration, even if the fitting portions 631F, 632F, 631R, 632R are moved in the direction in which the fitting portions 631F, 632F, 631R, 632R are pulled out from the fitted portions 641F, 642F, 641R, 642R, a force that acts in this instance on the engaging portions 61F, 61R and the engaged portions 62F, 62R does not act in a direction to cause elastic deformation of at least one of the engaging portions 61F, 61R and the engaged portions 62F, 62R. Consequently, the guides 53F, 53R and the sliders 55F, 55R can be firmly coupled to each other.

As shown in FIG. 4, the slider 55F includes a rack 66F, and the slider 55R includes a rack 66R. A pinion gear 67 is mounted on the sheet supporter 51 so as to mesh with the racks 66F, 66R of the respective sliders 55F, 55R. When the guide 53F and the slider 55F are moved in the sheet width direction, the rack 66F of the slider 55F causes the pinion gear 67 to rotate and the pinion gear 67 causes the rack 66R of the slider 55R to move. As a result, the guide 53R and the slider 55R are moved in a direction opposite to a direction in which the guide 53F and the slider 55F are moved, allowing the two guide surfaces 530F, 530R to move toward and away from each other. The sliders 55F, 55R are prohibited from moving in the conveyance direction of the sheet by ribs 691, 692, 693, 694, 695, 696 formed integrally with the sheet supporter 51.

As shown in FIGS. 4 and 6, the guide 53F includes a first hook 71F at a position spaced downstream of the first coupling portion 531F in the conveyance direction. As shown in FIGS. 5 and 6, the guide 53F includes a second hook 72F near the first coupling portion 531F. As shown in FIGS. 4 and 6, the guide 53R includes a first hook 71R at a position spaced downstream of the first coupling portion 531R in the conveyance direction. As shown in FIGS. 5 and 6, the guide 53R includes a second hook 72R near the first coupling portion 531R.

As shown in FIG. 4, the first hook 71F is hooked on a portion of the sheet supporter 51, namely, a downstream edge 512F of the sheet supporter 51, and is movable in the sheet width direction along the downstream edge 512F of the sheet supporter 51. The first hook 71R is hooked on a portion of the sheet supporter 51, namely, a downstream edge 512R of the sheet supporter 51, and is movable in the sheet width direction along the downstream edge 512R of the sheet supporter 51. The downstream edges 512F, 512F are used to hook the first hooks 71F, 71R on the sheet supporter 51, thus obviating the need for forming, in the sheet supporter 51, grooves into which the first hooks 71F, 71R are hooked. Consequently, the support surface 511 of the sheet supporter 51 is made simple and has a good external appearance.

As shown in FIG. 6, the first hook 71F includes a base portion 711F and a hook portion 712F. The base portion 711F protrudes from a facing surface 532F of the guide 53F facing the support surface 511 of the sheet supporter 51, in a direction intersecting the facing surface 532F. The hook portion 712F is bent from a distal end of the base portion 711F. At the downstream edge 512F of the sheet supporter 51, the hook portion 712F reaches, at its distal end, a position at which the hook portion 712F is to come into contact with another surface of the sheet supporter 51 opposite to the support surface 511 (hereinafter referred to as "opposite surface). As shown in FIG. 6, the first hook 71R includes a base portion 711R and a hook portion 712R. The base portion 711R protrudes from a facing surface 532R of the guide 53R facing the support surface 511 of the sheet supporter 51, in a direction intersecting the facing surface 532R. The hook portion 712R is bent from a distal end of the base portion 711R. At the downstream edge 512R of the sheet supporter 51, the hook portion 712R reaches, at its distal end, a position at which the hook portion 712R is to come into contact with the opposite surface of the sheet supporter 51.

The guide 53F has a through-hole 74F penetrating the guide 53F in the same direction as the direction in which the base portion 711F protrudes. The guide 53R has a through-hole 74R penetrating the guide 53R in the same direction as the direction in which the base portion 711R protrudes. When viewed from the direction of penetration of the through-hole 74F, 74R, the hook portion 712F is formed so as to overlap the through-hole 74F, and the hook portion 712R is formed so as to overlap the through-hole 74R. Unlike a configuration in which such through-holes 74F, 74R are not formed, this configuration enables the hook portions 712F, 712R, each having an undercut, to be easily formed by molding without using a slide core or the like, owing to the through-holes 74F, 74R.

The first hook 71F protrudes from a lower surface of the guide 53F (i.e., the facing surface 532F) at a position upstream of a downstream end of the guide 53F in the conveyance direction. The first hook 71R protrudes from a lower surface of the guide 53R (i.e., the facing surface 532R) at a position upstream of a downstream end of the guide 53R in the conveyance direction. Thus, each of the guides 53F, 53R does not have any portion that extends further downstream from its downstream end, so that the downstream end of each of the guides 53F, 53R has a straight shape extending in the sheet width direction, namely, the front-rear direction. Consequently, the downstream end of each of the guides 53F, 53R has a simple shape, achieving smooth conveyance of the sheet.

In the present embodiment, a portion of each guide 53R, 53F near its downstream end (i.e., portion at which each first hook 71F, 71R is provided) and a portion of the sheet supporter 51 near the downstream edges 512F, 512R are located under the upper cover 24 of the ADF portion 6, as shown in FIG. 2. When the MFP 1 is viewed from above, the downstream ends of the guides 53R, 53F and the downstream edges 512F, 512R of the sheet supporter 51 are covered with the upper cover 24. Consequently, this configuration is also effective for simplify the external appearance of the support surface 511 of the sheet supporter 51.

The first hooks 71F, 71R are respectively hooked on the downstream edges 512F, 512R of the sheet supporter 51, thereby preventing the guides 53F, 53R from floating up from the sheet supporter 51. The guide 53F and the slider 55F are coupled to each other at a position of the guide 53F located nearer to its upstream end than its central portion in the conveyance direction, namely, at a position of the guide 53F located upstream of its central portion in the conveyance direction. The guide 53R and the slider 55R are coupled to each other at a position of the guide 53R located nearer to its upstream end than its central portion in the conveyance direction, namely, at a position of the guide 53R located upstream of its central portion in the conveyance direction. Thus, the guides 53F, 53R are prevented from floating up from the sheet supporter 51 also at the coupled positions, namely, at the first coupling portions 531F, 531R and the second coupling portions 552F, 552R. In other words, each of the guides 53F, 53R is prevented from floating up away from the sheet supporter 51 at both of the position near its upstream end and the position near its downstream end between which the central portion in the conveyance direction is interposed.

Figure 8:
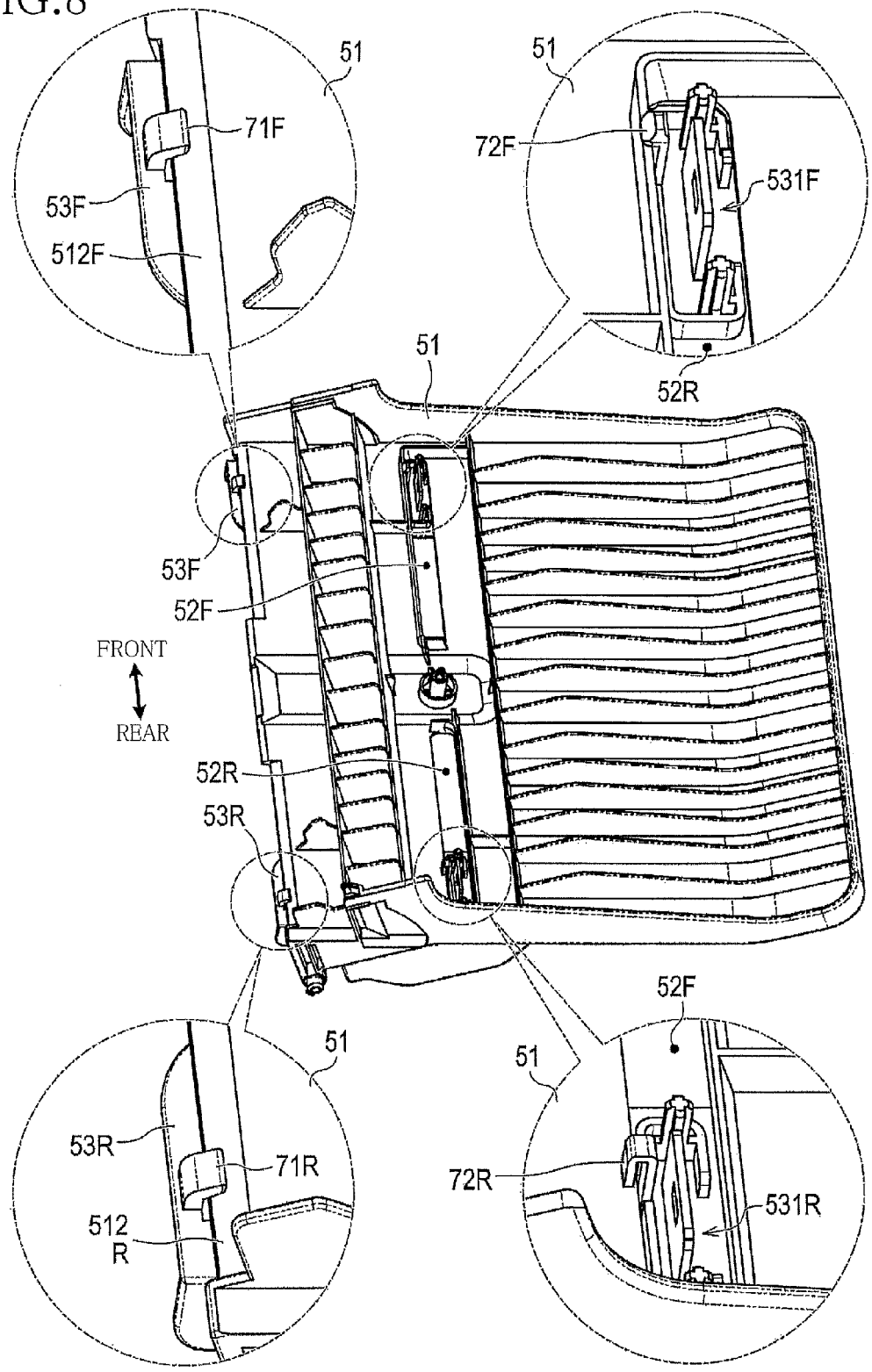
FIG. 8 is a perspective view showing a state in which the guides are temporarily mounted on a sheet supporter.

The second hook 72F is provided for temporarily mounting the guide 53F on the sheet supporter 51, and the second hook 72R is provided for temporarily mounting the guide 53R on the sheet supporter 51. As shown in FIG. 8, the guide 53F is temporarily and independently mountable on the sheet supporter 51 by hooking the first hook 71F and the second hook 72F on the sheet supporter 51, without using the slider 55F. The guide 53R is temporarily and independently mountable on the sheet supporter 51 by hooking the first hook 71R and the second hook 72R on the sheet supporter 51, without using the slider 55R. Such temporary mounting of the guides 53F, 53R prevents the guides 53F, 53R from falling off the sheet supporter 51 even if a worker does not support or hold the guides 53F, 53R during assembling work. This configuration simplifies work for coupling the sliders 55F, 55R to the guides 53F, 53R, as compared with a configuration in which the guides 53F, 53R are not designed to be temporarily mountable.

Though the first hooks 71F, 71R are used in the temporary mounting, the first hooks 71F, 71R are provided originally for preventing the guides 53F, 53R from floating up from the sheet supporter 51 after the assembling work has been finished. In view of this, the first hooks 71F, 71R need to have rigidity that does not allow easy deformation thereof. In contrast, the second hooks 72F, 72R are provided for the temporary mounting described above. The first coupling portions 531F, 531R and the second coupling portions 552F, 552R serve the function of preventing the guides 53F, 53R from floating up from the sheet supporter 51 after the assembling work. In view of this, the second hooks 72F, 72R need not have excessively high rigidity, but rather have a structure that allows easy elastic deformation for easy temporary mounting.

As shown in FIG. 6, the guide 53F includes two contact portions 751F, 752F (each as one example of "first contact portion") respectively provided at one and the other of two positions of the guide 53F between which the first hook 71F is interposed in the sheet width direction. The contact portions 751F, 752F are held in contact with the support surface 511 of the sheet supporter 51. Similarly, the guide 53R includes two contact portions 751R, 752R (each as one example of "first contact portion") respectively provided at one and the other of two positions of the guide 53R between which the first hook 71R is interposed in the sheet width direction. The contact portions 751R, 752R are held in contact with the support surface 511 of the sheet supporter 51. The contact portion 751F is disposed on the rear side and the contact portion 752F is disposed on the front side with the first hook 71F interposed therebetween in the sheet width direction. The contact portion 751R is disposed on the front side and the contact portion 752R is disposed on the rear side with the second hook 71R interposed therebetween in the sheet width direction. As shown in FIG. 5, the guide 53F includes two contact portions 753F, 754F (each as one example of "second contact portion") provided in the vicinity of the first coupling portion 531F so as to be held in contact with the support surface 511 of the sheet supporter 51 at two positions of the guide 53F that are spaced apart from each other in the sheet width direction. Similarly, the guide 53R includes two contact portions 753R, 754R (each as one example of "second contact portion") provided in the vicinity of the first coupling portion 531R so as to be held in contact with the support surface 511 of the sheet supporter 51 at two positions of the guide 53R that are spaced apart from each other in the sheet width direction. The contact portion 753F is adjacently disposed to the right of the fitting portion 631F, and the contact portion 754F is adjacently disposed to the right of the fitting portion 632F. The contact portion 753R is adjacently disposed to the right of the fitting portion 631R, and the contact portion 754R is adjacently disposed to the right of the fitting portion 632R.

Figure 9A:
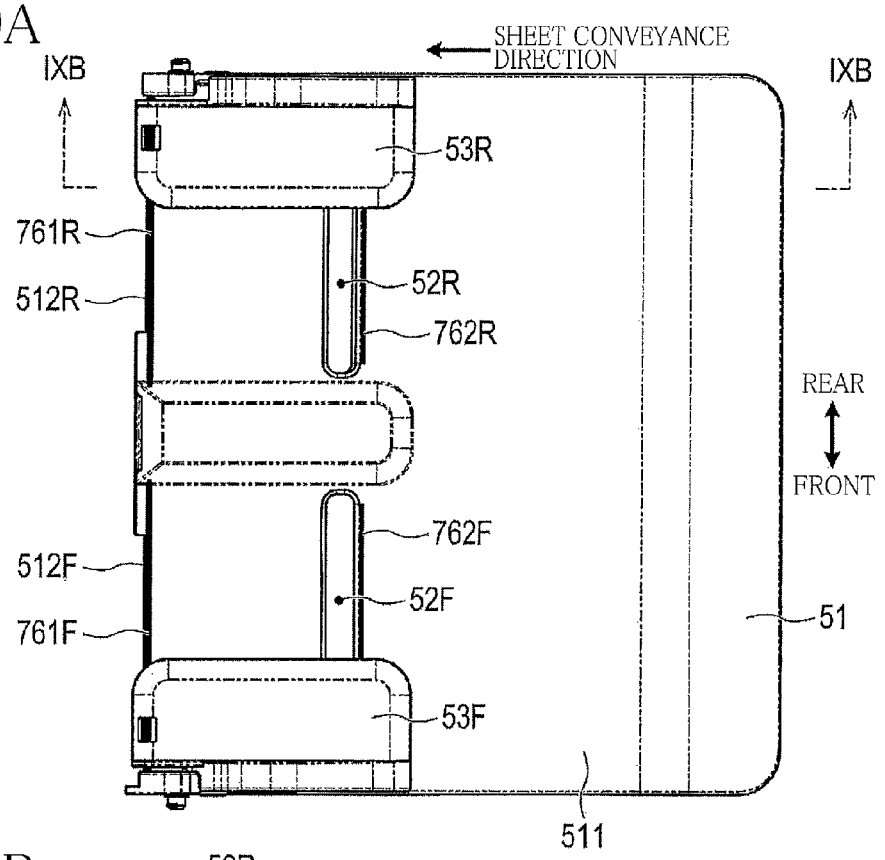
FIG. 9A is a view for explaining a cut portion corresponding to a cross-section shown in FIG. 9B

As shown in FIG. 9A, straight protrusions 761F, 761R, 762F, 762R, each extending in the sheet width direction, are formed on the support surface 511 of the sheet supporter 51. The protrusion 761F and the protrusion 761R are formed respectively along the downstream edge 512F and the downstream edge 512R of the sheet supporter 51, so that the protrusions 761F, 761R are inconspicuous in external appearance. The protrusion 762F and the protrusion 762R are formed respectively along edges of the respective elongate openings 52F and elongate opening 52R, so that the protrusions 762F, 762R are inconspicuous in external appearance.

Figure 9B:
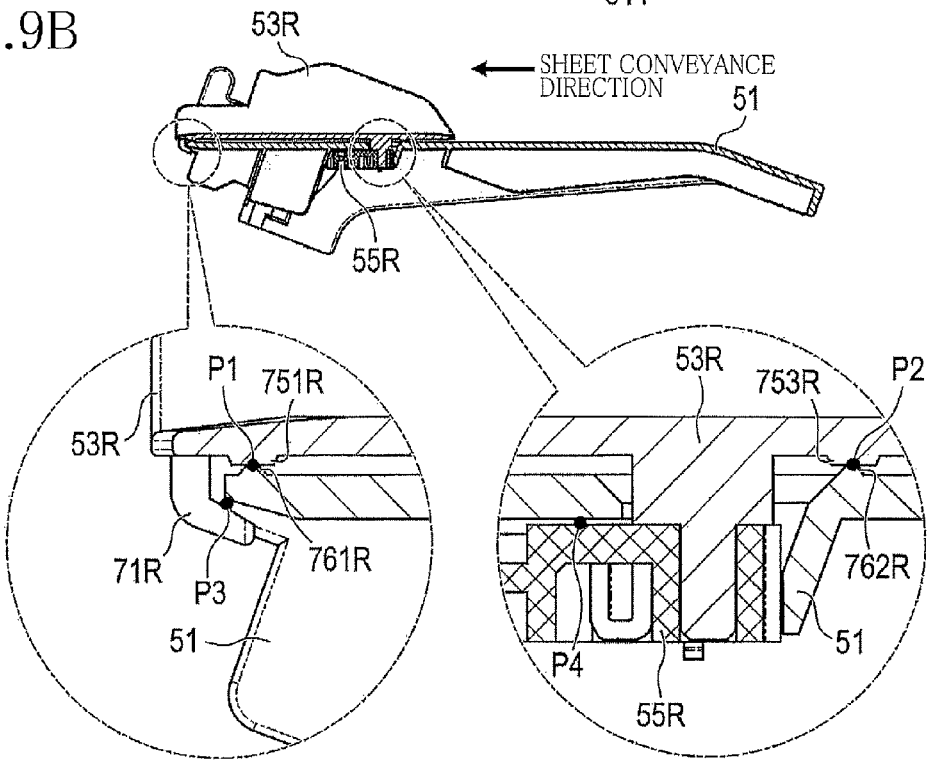
FIG. 9B is a cross-sectional view of the cut portion taken along line IXB-IXB in FIG. 9A.

At a position P1 shown in FIG. 9B, the contact portions 751F, 752F are in contact with the protrusion 761F while the contact portions 751R, 752R are in contact with the protrusion 761R. Though FIG. 9B illustrates the contact portion 751R and the protrusion 761R which are in contact with each other at the position P1, the contact portions 751F, 752F are in contact with the protrusion 761F, and the contact portion 752R is in contact with the protrusion 761R, at a position corresponding to the position P1 at which the contact portion 751R and the protrusion 761R are in contact with each other, when viewed from the front side.

At a position P2 shown in FIG. 9B, the contact portions 753F, 754F are in contact with the protrusion 762F while the contact portions 753R, 754R are in contact with the protrusion 762R. Though FIG. 9B illustrates the contact portion 753R and the protrusion 762R which are in contact with each other at the position P2, the contact portions 753F, 754F are in contact with the protrusion 762F, and the contact portion 754R is in contact with the protrusion 762R, at a position corresponding to the position P2 at which the contact portion 753R and the protrusion 762R are in contact with each other, when viewed from the front side.

In an instance where the downstream ends of the guides 53F, 53R are moved in a direction in which the downstream ends are lifted up away from the support surface 511 of the sheet supporter 51, the first hooks 71F, 71R come into contact with the opposite surface (the lower surface) of the sheet supporter 51 at a position P3 shown in FIG. 9B. Though FIG. 9B illustrates the first hook 71R, the first hook 71F also comes into contact with the opposite surface of the sheet supporter 51 at a position corresponding to the position P3 at which the first hook 71R comes into contact with the sheet supporter 51, when viewed from the front side.

In an instance where the upstream ends of the guides 53F, 53R are moved in a direction in which the upstream ends are lifted up away from the support surface 511 of the sheet supporter 51, the sliders 55F, 55R come into contact with the opposite surface (the lower surface) of the sheet supporter 51 at a position P4 shown in FIG. 9B. Though FIG. 9B illustrates the slider 55R, the slider 55F also comes into contact with the sheet supporter 51 at a position corresponding to the position P4 at which the slider 55R comes into contact with the sheet supporter 51, when viewed from the front side.

Thus, the guides 53F, 53R and the sliders 55F, 55R are supported by the sheet supporter 51 at the four positions P1-P4 in the conveyance direction. In this configuration, even if the guides 53F, 53R and the sliders 55F, 55R are inclined within a tolerance when moved, it is possible to avoid excessively large inclination of the guides 53F, 53R and the sliders 55F, 55R and to smoothly move the guides 53F, 53R and the sliders 55F, 55R, as compared with a configuration in which the guides 53F, 53R and the sliders 55F, 55R are supported by the sheet supporter 51 at three positions in the conveyance direction.

Figure 10A:
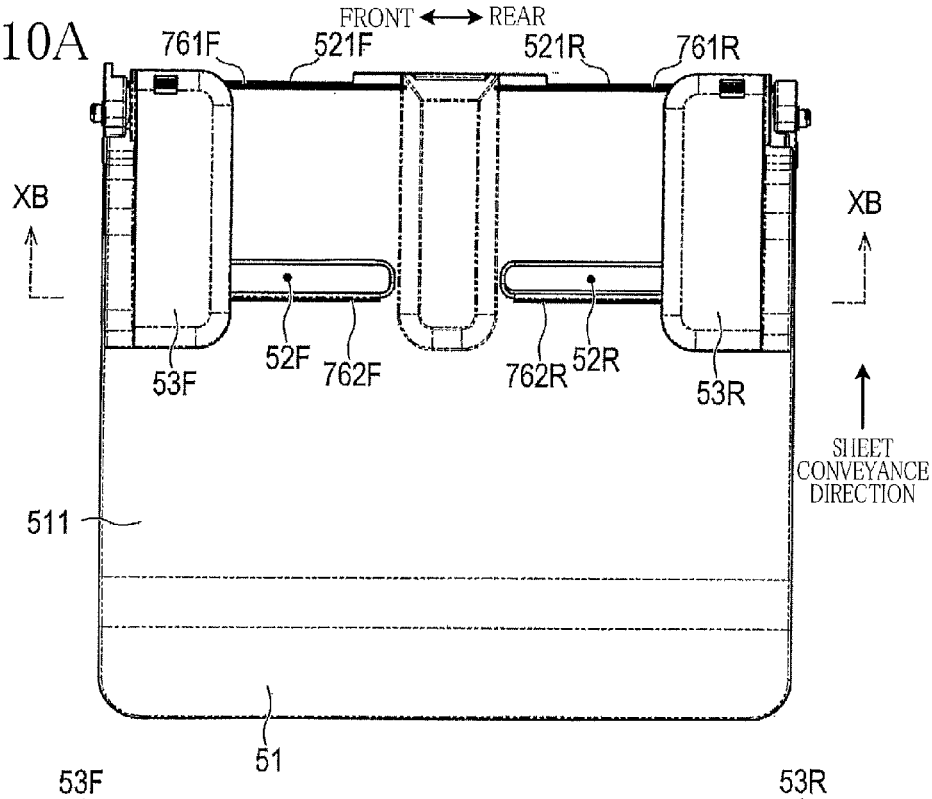
FIG. 10A is a view for explaining a cut portion corresponding to a cross-section shown in FIG. 10B
Figure 10B:
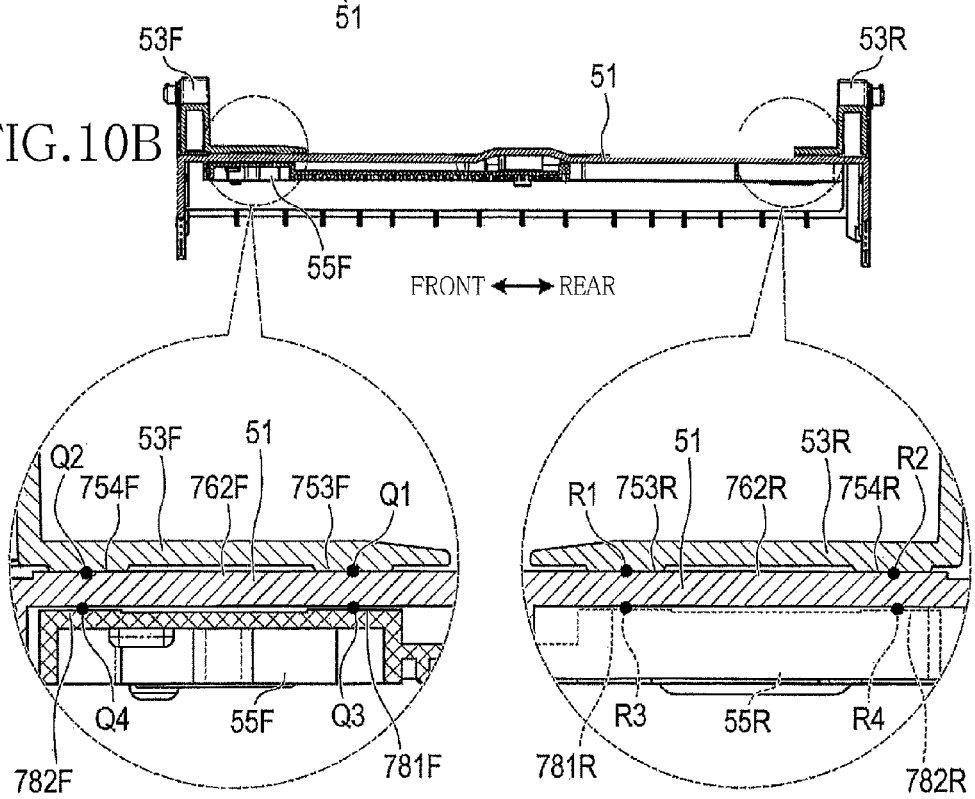
FIG. 10B is a cross-sectional view of the cut portion taken along line XB-XB in FIG. 10A.

As shown in FIGS. 10A and 10B, the contact portion 753F is in contact with the protrusion 762F at a position Q1 and the contact portion 754F is in contact with the protrusion 762F at a position Q2, when viewed from the upstream side in the conveyance direction. The slider 55F includes contact portions 781F, 782F (each as one example of "third contact portion") protruding toward the sheet supporter 51. The contact portion 781F is in contact with the sheet supporter 51 at a position Q3 and the contact portion 782F is in contact with the sheet supporter 51 at a position Q4, when viewed from the upstream side in the conveyance direction. Thus, the guide 53F and the slider 55F are supported by the sheet supporter 51 at the four positions Q1-Q4 in the sheet width direction. In this configuration, even if the guide 53F and the slider 55F are inclined within a tolerance when moved, it is possible to avoid excessively large inclination of the guide 53F and the slider 55F and to smoothly move the guide 53F and the slider 55F, as compared with a configuration in which the guide 53F and the slider 55F are supported by the sheet supporter 51 at three positions in the sheet width direction.

As shown in FIG. 10B, the contact portion 753R is in contact with the protrusion 762R at a position R1 and the contact portion 754R is in contact with the protrusion 762R at a position R2, when viewed from the upstream side in the conveyance direction. The slider 55R includes contact portions 781R, 782R (each as one example of "third contact portion") protruding toward the sheet supporter 51. The contact portion 781R is in contact with the sheet supporter 51 at a position R3 and the contact portion 782R is in contact with the sheet supporter 51 at a position R4, when viewed from the upstream side in the conveyance direction. Thus, the guide 53R and the slider 55R are supported by the sheet supporter 51 at the four positions R1-R4 in the sheet width direction. In this configuration, even if the guide 53R and the slider 55R are inclined within a tolerance when moved, it is possible to avoid excessively large inclination of the guide 53R and the slider 55R and to smoothly move the guide 53R and the slider 55R, as compared with a configuration in which the guide 53R and the slider 55R are supported by the sheet supporter 51 at three positions.

Advantageous Effects

In the MFP 1 described above, the guide 53F and the slider 55F are coupled to each other through the elongate opening 52F, and the first hook 71F is hooked on a portion of the sheet supporter 51, whereby the guide 53F and the slider 55F are mounted on the sheet supporter 51. Further, the guide 53R and the slider 55R are coupled to each other through the elongate opening 52R, and the first hook 71R is hooked on a portion of the sheet supporter 51, whereby the guide 53R and the slider 55R are mounted on the sheet supporter 51. It is thus possible to more effectively avoid or reduce wobbling of the guides 53F, 53R and the sliders 55F, 55R and floating of the guides 53F, 53R away from the sheet supporter 51, as compared with a configuration in which the first hooks 71F, 71R or equivalents thereto are not provided. Consequently, the operability of the guides 53F, 53R can be enhanced.

In the MFP 1 described above, the coupled position at which the guide 53F and the slider 55F are coupled and the coupled position at which the guide 53R and the slider 55R are coupled are respectively located near the upstream ends of the respective guides 53F, 53R in the conveyance direction. Further, the hooked position at which the first hook 71F is hooked on the sheet supporter 51 and the hooked position at which the first hook 71R is hooked on the sheet supporter 51 are respectively located near the downstream ends of the respective guides 53F, 53R in the conveyance direction. In this configuration, the guides 53F, 53R are not likely to move away from the support surface 511, as compared with a configuration in which both of the coupled positions and the hooked positions are located near the upstream ends or near the downstream ends. It is thus possible to enhance the effect of avoiding or reducing wobbling of the guides 53F, 53R and floating of the guides 53F, 53R away from the sheet supporter 51.

In the MFP 1 described above, in the vicinity of the first hook 71F, the contact portions 751F, 752F are in contact with the support surface 511 of the sheet supporter 51 at the respective two positions between which the first hook 71F is interposed in the sheet width direction. In the vicinity of the first hook 71R, the contact portions 751R, 752R are in contact with the support surface 511 of the sheet supporter 51 at the respective two positions between which the first hook 71R is interposed in the sheet width direction. It is consequently possible to enhance the effect of avoiding or reducing wobbling of the guides 53F, 53R and floating of the guides 53F, 53R away from the sheet supporter 51, as compared with a configuration in which each guide 53F, 53R is in contact with the support surface 511 of the sheet supporter 51 only at one position of each guide 53F, 53R. Further, as compared with a configuration in which each guide 53F, 53R is in contact with the support surface 511 of the sheet supporter 51 over its entire surface, the guides 53F, 53R can be in contact with the support surface 511 at specific positions in the present MFP 1. It is consequently possible to reduce frictional resistance acting between the guides 53F, 53R and the support surface 511 and to accordingly avoid wear of the support surface 511, resulting in smooth movements of the guides 53F, 53R.

In the MFP 1 described above, in the vicinity of the first coupling portions 531F, 531R and the second coupling portions 552F, 552R at which the guides 53F, 53R and the sliders 55F, 55R are coupled, the contact portions 753F, 754F of the guide 53F are in contact with the support surface 511 of the sheet supporter 51 at the two positions of the guide 53F spaced apart from each other in the sheet width direction, and the contact portions 753R, 754R of the guide 53R are in contact with the support surface 511 of the sheet supporter 51 at the two positions of the guide 53R spaced apart from each other in the sheet width direction. Further, the contact portions 781F, 782F of the slider 55F are in contact with the opposite surface of the support surface 511 at the two positions of the slider 55F spaced apart from each other in the sheet width direction, and the contact portions 781R, 782R of the slider 55R are in contact with the opposite surface of the sheet supporter 51 at the two positions of the slider 55R spaced apart from each other in the sheet width direction. It is consequently possible to enhance the effect of avoiding or reducing wobbling of the guides 53F, 53R and the sliders 55F, 55R and floating of the guides 53F, 53R away from the sheet supporter 51, as compared with a configuration in which each guide 53F, 53R is in contact with the support surface 511 of the sheet supporter 51 only at one position of each guide 53F, 53R or a configuration in which each slider 55F, 55R is in contact with the opposite surface of the sheet supporter 51 only at one position of each slider 55F, 55R. Further, as compared with a configuration in which each guide 53F, 53R is in contact with the support surface 511 of the sheet supporter 51 over its entire surface or a configuration in which each slider 55F, 55R is in contact with the opposite surface of the sheet supporter 51 over its entire surface, the guides 53F, 53R can be in contact with the support surface 511 at specific positions or the sliders 55F, 55R can be in contact with the opposite surface of the sheet supporter 51 at specific positions. It is consequently possible to reduce frictional resistance acting between the guides 53F, 53R and the sheet supporter 51 and between the sliders 55F, 55R and the sheet supporter 51 and to accordingly avoid wear of the support surface 511, resulting in smooth movements of the guides 53F, 53R.

The protrusion 762F and the protrusion 762R are formed respectively along edges of the respective elongate openings 52F, 52R, so that the protrusions 762F, 762R are visually inconspicuous, resulting in a good appearance of the sheet supply portion 21.

In the MFP 1 described above, the engaging portions 61F, 61R, the engaged portions 62F, 62R, the fitting portions 631F, 632F, 631R, 632R, and the fitted portions 641F, 642F, 641R, 642R are used in combination. In this configuration, the fitting portions 631F, 632F, 631R, 632R and the fitted portions 641F, 642F, 641R, 642R prohibit the guides 53F, 53R and the sliders 55F, 55R from moving relative to each other in a direction in which at least one of: the engaging portions 61F, 61R; and the engaged portions 62F, 62R are elastically deformed. Consequently, the guide 53F and the slider 55F can be firmly coupled to each other, and the guide 53R and the slider 55R can be firmly coupled to each other.

In the MFP 1 described above, the guides 53F, 53R can be temporarily mounted on the sheet supporter 51 through the use of the second hooks 72F, 72R, without using the sliders 55F, 55R. By temporarily mounting the guides 53F, 53R on the sheet supporter 51, the sliders 55F, 55R can be mounted on the guides 53F, 53R even if a worker does not support or hold the guides 53F, 53R. Consequently, the mounting work can be easily carried out, resulting in improved productivity of the sheet supply portion 21.

Modifications

While the embodiment has been described above, it is to be understood that the disclosure is not limited to the details of the illustrated embodiment, but may be embodied with various other changes without departing from the spirit and the scope of the disclosure.

In the illustrated embodiment, the MFP 1 has the image reader 3 and the ADF portion 6 as one example of the sheet conveying device. An image scanner device having only an image scanning function may include the configuration described above.

Supplemental Explanation

It can be understood based on the illustrated embodiment that the sheet supporting device and the sheet conveying device explained above may have the following configurations.

In the sheet supporting device and the sheet conveying device described above, the first hook may include: a base portion protruding from a facing surface of the guide that faces the support surface of the sheet supporter, in a direction intersecting the facing surface; and a hook portion that is bent from a distal end of the base portion so as to reach a position at which the hook portion is to come into contact with another surface of the sheet supporter opposite to the support surface, and the guide may be provided with a through-hole penetrating the guide in the same direction as the direction in which the base portion protrudes, the hook portion being formed so as to overlap the through-hole as viewed from a direction of penetration of the through-hole.

According to the sheet supporting device and the sheet conveying device described above, the first hook includes the base portion and the hook portion, and the guide is provided with the through-hole. Owing to the through-hole, the hook portion shaped to have an undercut can be easily formed by molding without using a slide core or the like, resulting in enhanced productivity of the guide.

In the sheet supporting device and the sheet conveying device described above, the first hook may be hooked on a downstream edge of the sheet supporter in the conveyance direction.

According to the sheet supporting device and the sheet conveying device described above, the first hook is hooked on the downstream edge of the sheet supporter in the conveyance direction, thus obviating the need for additionally forming, at a portion of the sheet supporter other than the downstream edge, a groove, an elongate hole, or the like, in which the first hook is hooked. Consequently, the shape of the sheet supporter can be simplified, resulting in enhanced productivity of the sheet supporter.

In the sheet supporting device and the sheet conveying device described above, the guide and the slider may be coupled to each other upstream of a central portion of the guide in the conveyance direction, and the first hook may be hooked on the sheet supporter downstream of the central portion of the guide in the conveyance direction.

According to the sheet supporting device and the sheet conveying device described above, the coupled position at which the guide and the slider are coupled is located near an upstream end of the guide in the conveyance direction. The hooked position at which the first hook is hooked on the sheet supporter is located near a downstream end of the guide in the conveyance direction. In this configuration, the guide is not likely to move away from the support surface, as compared with a configuration in which both of the coupled position and the hooked position are located near the upstream end of the guide or the downstream end of the guide. It is thus possible to enhance the effect of avoiding or reducing wobbling of the guide and floating of the guide away from the sheet supporter.

In the sheet supporting device and the sheet conveying device described above, the guide may include two first contact portions one of which is provided at one of two positions of the guide between which the first hook is interposed in the width direction of the sheet, and the other of which is provided at the other of the two positions, the two first contact portions being in contact with the support surface of the sheet supporter.

According to the sheet supporting device and the sheet conveying device described above, in the vicinity of the first hook, the first contact portions are in contact with the support surface of the sheet supporter at the respective two positions between which the first hook is interposed in the sheet width direction. It is consequently possible to enhance the effect of avoiding or reducing wobbling of the guide and floating of the guide away from the sheet supporter, as compared with a configuration in which the guide is in contact with the support surface of the sheet supporter only at one position of the guide. Further, as compared with a configuration in which the guide is in contact with the support surface of the sheet supporter over its entire surface, the guide can be in contact with the support surface at specific positions. It is consequently possible to reduce frictional resistance acting between the guide and the support surface, resulting in a smooth movement of the guide.

In the sheet supporting device and the sheet conveying device described above, the guide may include two second contact portions provided in the vicinity of the first coupling portion so as to be in contact with the support surface of the sheet supporter at two positions of the guide that are spaced apart from each other in the width direction of the sheet, and the slider may include two third contact portions in the vicinity of the second coupling portion so as to be in contact with another surface of the sheet supporter opposite to the support surface at two positions of the slider that are spaced apart from each other in the width direction of the sheet.

According to the sheet supporting device and the sheet conveying device described above, in the vicinity of the first coupling portion and the second coupling portion at which the guide and the slider are coupled, the second contact portions are in contact with the support surface of the sheet supporter at the two positions of the guide spaced apart from each other in the sheet width direction, and the third contact portions are in contact with another surface of the sheet supporter opposite to the support surface at the two positions of the slider spaced apart from each other in the sheet width direction. It is consequently possible to enhance the effect of avoiding or reducing wobbling of the guide and the slider and floating of the guide away from the sheet supporter, as compared with a configuration in which the guide is in contact with the support surface of the sheet supporter only at one position of the guide or a configuration in which the slider is in contact with another surface of the sheet supporter opposite to the support surface only at one position of the slider. Further, as compared with a configuration in which the guide is in contact with the support surface of the sheet supporter over its entire surface or a configuration in which the slider is in contact another surface of the sheet supporter opposite to the support surface over its entire surface, the guide can be in contact with the support surface at specific positions or the slider can be in contact with another surface of the sheet supporter opposite to the support surface at specific positions. It is consequently possible to reduce frictional resistance acting between the guide and the sheet supporter and between the slider and the sheet supporter, resulting in a smooth movement of the guide.

In the sheet supporting device and the sheet conveying device described above, a protrusion may be formed on the support surface of the sheet supporter so as to extend in the width direction of the sheet, and the second contact portions may be in contact with the protrusion.

According to the sheet supporting device and the sheet conveying device described above, the second contact portion is in contact with the protrusion. It is thus possible to limit a range of contact of the second contact portion to a range of the sheet supporter in which the protrusion is formed, reducing a possibility that the second contact portion contacts an unintended portion of the sheet supporter.

In the sheet supporting device and the sheet conveying device described above, the protrusion may be formed along an edge of the elongate opening.

According to the sheet supporting device and the sheet conveying device described above, the protrusion is formed along the edge of the elongate opening, so that the protrusion is visually inconspicuous, resulting in a good appearance of the sheet supporting device.

In the sheet supporting device and the sheet conveying device described above, one of the first coupling portion and the second coupling portion may include an engaging portion while the other of the first coupling portion and the second coupling portion may include an engaged portion, and one of the first coupling portion and the second coupling portion may include a fitting portion while the other of the first coupling portion and the second coupling portion may include a fitted portion. When the guide and the slider are coupled to each other, the fitting portion may be fitted into the fitted portion, so that the guide and the slider are prohibited from moving relative to each other in directions other than a direction in which the fitting portion is pulled out from the fitted portion. When the guide and the slider are coupled to each other, the engaging portion and the engaged portion may be brought into engagement with each other such that at least one of the engaging portion and the engaged portion is elastically deformed in a direction different from the direction in which the fitting portion is pulled out from the fitted portion, so that the guide and the slider are prohibited from moving relative to each other in the direction in which the fitting portion is pulled out from the fitted portion.

According to the sheet supporting device and the sheet conveying device described above, the engaging portion, the engaged portion, the fitting portion, and the fitted portion are used in combination. In this configuration, the fitting portion and the fitted portion prohibit the guide and the slider from moving relative to each other in the direction in which at least one of the engaging portion and the engaged portion is elastically deformed. Consequently, the guide and the slider can be firmly coupled to each other.

In the sheet supporting device and the sheet conveying device described above, the guide may include a second hook hooked on the sheet supporter, the guide being configured to be temporarily mountable on the sheet supporter by hooking the second hook on the sheet supporter even in a state in which the guide is not yet coupled with the slider.

According to the sheet supporting device and the sheet conveying device described above, the guide can be temporarily mounted on the sheet supporter through the use of the second hook, without using the slider. By temporarily mounting the guide on the sheet supporter, the slider can be mounted on the guide even if a worker does not support or hold the guide. Consequently, the mounting work can be easily carried out, resulting in improved productivity of the sheet supporting device.

What is claimed is:

1. A sheet supporting device, comprising:

a sheet supporter having a support surface for supporting a sheet to be conveyed downstream in a conveyance direction;

a guide disposed on one of opposite sides of the sheet supporter on which the support surface is provided and configured to be movable along the support surface in a width direction of the sheet orthogonal to the conveyance direction, the guide having a guide surface configured to come into contact with an edge, in the width direction, of the sheet supported on the sheet supporter; and a slider disposed on the other of the opposite sides of the sheet supporter so as to be movable in the width direction of the sheet, wherein the sheet supporter is provided with an elongate opening penetrating the support surface and extending in the width direction of the sheet, wherein the guide and the slider are coupled to each other through the elongate opening, such that the guide and the slider are movable together in the width direction of the sheet, wherein the guide includes a first hook hooked on a portion of the sheet supporter at a position spaced downstream of the elongate opening in the conveyance direction, the first hook being configured to be movable in the width direction of the sheet along the portion of the sheet supporter, wherein the guide and the slider are coupled to each other upstream of a central portion of the guide in the conveyance direction, and wherein the first hook is hooked on the sheet supporter downstream of the central portion of the guide in the conveyance direction.

2. The sheet supporting device according to claim 1, wherein the first hook includes: a base portion protruding from a facing surface of the guide that faces the support surface of the sheet supporter, in a direction intersecting the facing surface; and a hook portion that is bent from a distal end of the base portion so as to reach a position at which the hook portion is to come into contact with another surface of the sheet supporter opposite to the support surface, and wherein the guide is provided with a through-hole penetrating the guide in the same direction as the direction in which the base portion protrudes, the hook portion being formed so as to overlap the through-hole as viewed from a direction of penetration of the through-hole.

3. The sheet supporting device according to claim 1, wherein the first hook is hooked on a downstream edge of the sheet supporter in the conveyance direction.

4. The sheet supporting device according to claim 1, wherein the guide includes a first coupling portion and the slider includes a second coupling portion, the first coupling portion and the second coupling portion being coupled to each other through the elongate opening so as to couple the guide and the slider to each other.

5. The sheet supporting device according to claim 4, wherein one of the first coupling portion and the second coupling portion includes an engaging portion while the other of the first coupling portion and the second coupling portion includes an engaged portion, wherein one of the first coupling portion and the second coupling portion includes a fitting portion while the other of the first coupling portion and the second coupling portion includes a fitted portion, and wherein, when the guide and the slider are coupled to each other, the fitting portion is fitted into the fitted portion, so that the guide and the slider are prohibited from moving relative to each other in directions other than a direction in which the fitting portion is pulled out from the fitted portion, and wherein, when the guide and the slider are coupled to each other, the engaging portion and the engaged portion are brought into engagement with each other such that at least one of the engaging portion and the engaged portion is elastically deformed in a direction different from the direction in which the fitting portion is pulled out from the fitted portion, so that the guide and the slider are prohibited from moving relative to each other in the direction in which the fitting portion is pulled out from the fitted portion.

6. The sheet supporting device according to claim 1, wherein the guide includes a second hook hooked on the sheet supporter, the guide being configured to be temporarily mountable on the sheet supporter by hooking the second hook on the sheet supporter even in a state in which the guide is not yet coupled with the slider.

7. The sheet supporting device according to claim 1, comprising two guides each as the guide and two sliders each as the slider, wherein the two guides are located such that the guide surfaces of the respective two guides are opposed to each other, wherein each of the two sliders includes a rack, wherein a pinion gear is mounted on the sheet supporter so as to mesh with the racks of the two sliders, and wherein, when one of the two guides and one of the two sliders are moved in the width direction of the sheet, the rack of the one of the two sliders causes the pinion gear to rotate and the pinion gear causes the rack of the other of the two sliders to move, so that the other of the two guides and the other of the two sliders are moved in a direction opposite to a direction in which the one of the two guides and the one of the two sliders are moved, allowing the guide surfaces of the two guides to move toward and away from each other.

8. The sheet supporting device according to claim 1, wherein a coupled position at which the guide and the slider are coupled, the first hook, and a downstream edge of the guide in the conveyance direction are arranged in this order from an upstream side toward a downstream side in the conveyance direction.

9. A sheet supporting device, comprising:

a sheet supporter having a support surface for supporting a sheet to be conveyed downstream in a conveyance direction;

a guide disposed on one of opposite sides of the sheet supporter on which the support surface is provided and configured to be movable along the support surface in a width direction of the sheet orthogonal to the conveyance direction, the guide having a guide surface configured to come into contact with an edge, in the width direction, of the sheet supported on the sheet supporter; and a slider disposed on the other of the opposite sides of the sheet supporter so as to be movable in the width direction of the sheet, wherein the sheet supporter is provided with an elongate opening penetrating the support surface and extending in the width direction of the sheet, wherein the guide and the slider are coupled to each other through the elongate opening, such that the guide and the slider are movable together in the width direction of the sheet, wherein the guide includes a first hook hooked on a portion of the sheet supporter at a position spaced downstream of the elongate opening in the conveyance direction, the first hook being configured to be movable in the width direction of the sheet along the portion of the sheet supporter, and wherein the guide includes two first contact portions one of which is provided at one of two positions of the guide between which the first hook is interposed in the width direction of the sheet, and the other of which is provided at the other of the two positions, the two first contact portions being in contact with the support surface of the sheet supporter.

10. A sheet supporting device, comprising:

a sheet supporter having a support surface for supporting a sheet to be conveyed downstream in a conveyance direction;

a guide disposed on one of opposite sides of the sheet supporter on which the support surface is provided and configured to be movable along the support surface in a width direction of the sheet orthogonal to the conveyance direction, the guide having a guide surface configured to come into contact with an edge, in the width direction, of the sheet supported on the sheet supporter; and a slider disposed on the other of the opposite sides of the sheet supporter so as to be movable in the width direction of the sheet, wherein the sheet supporter is provided with an elongate opening penetrating the support surface and extending in the width direction of the sheet, wherein the guide and the slider are coupled to each other through the elongate opening, such that the guide and the slider are movable together in the width direction of the sheet, wherein the guide includes a first hook hooked on a portion of the sheet supporter at a position spaced downstream of the elongate opening in the conveyance direction, the first hook being configured to be movable in the width direction of the sheet along the portion of the sheet supporter, wherein the guide includes a first coupling portion and the slider includes a second coupling portion, the first coupling portion and the second coupling portion being coupled to each other through the elongate opening so as to couple the guide and the slider to each other, wherein the guide includes two second contact portions provided in the vicinity of the first coupling portion so as to be in contact with the support surface of the sheet supporter at two positions of the guide that are spaced apart from each other in the width direction of the sheet, and wherein the slider includes two third contact portions in the vicinity of the second coupling portion so as to be in contact with another surface of the sheet supporter opposite to the support surface at two positions of the slider that are spaced apart from each other in the width direction of the sheet.

11. The sheet supporting device according to claim 10, wherein a protrusion is formed on the support surface of the sheet supporter so as to extend in the width direction of the sheet, and wherein the second contact portions are in contact with the protrusion.

12. The sheet supporting device according to claim 11, wherein the protrusion is formed along an edge of the elongate opening.

13. A sheet conveying device, comprising:

a sheet conveyor configured to convey a sheet downstream in a conveyance direction along a conveyance path;

a sheet supporter having a support surface for supporting a sheet to be conveyed downstream in a conveyance direction by the sheet conveyor;

a guide disposed on one of opposite sides of the sheet supporter on which the support surface is provided and configured to be movable along the support surface in a width direction of the sheet orthogonal to the conveyance direction, the guide having a guide surface configured to come into contact with an edge, in the width direction, of the sheet supported on the sheet supporter; and a slider disposed on the other of the opposite sides of the sheet supporter so as to be movable in the width direction of the sheet, wherein the sheet supporter is provided with an elongate opening penetrating the support surface and extending in the width direction of the sheet, wherein the guide and the slider are coupled to each other through the elongate opening, such that the guide and the slider are movable together in the width direction of the sheet, wherein the guide includes a first hook hooked on a portion of the sheet supporter at a position spaced downstream of the elongate opening in the conveyance direction, the first hook being configured to be movable in the width direction of the sheet along the portion of the sheet supporter, wherein the guide and the slider are coupled to each other upstream of a central portion of the guide in the conveyance direction, and wherein the first hook is hooked on the sheet supporter downstream of the central portion of the guide in the conveyance direction.

* * * * *